United States Patent [19]

Jones

[11] 4,177,034

[45] Dec. 4, 1979

[54] RETROFIT IGNITER

[75] Inventor: Richard E. Jones, Los Alamitos, Calif.

[73] Assignee: Robertshaw Controls Company, Richmond, Va.

[21] Appl. No.: 865,406

[22] Filed: Dec. 29, 1977

[51] Int. Cl.[2] ..... F23N 5/10; F23Q 9/00; F16L 3/08; H01L 35/00

[52] U.S. Cl. ..... 431/264; 431/343; 431/80; 248/65; 136/230

[58] Field of Search ..... 431/343, 264, 80; 248/65, 300, 205 R; 136/230, 217, 242

[56] References Cited

U.S. PATENT DOCUMENTS

| | | | |
|---|---|---|---|
| Re. 26,743 | 11/1969 | Loveland | 431/343 |
| D. 87,702 | 9/1932 | Aufiero | 248/300 |
| 332,383 | 12/1885 | Cole et al. | 248/65 |
| 2,355,216 | 8/1944 | Guelson | 431/343 |
| 2,751,973 | 6/1956 | Meusy | 431/80 |
| 2,959,218 | 11/1960 | Hajny | 431/80 |
| 3,208,505 | 9/1965 | Craemer | 431/80 |
| 3,286,762 | 11/1966 | McIntosh et al. | 431/80 |
| 3,441,450 | 4/1969 | Frommel | 136/217 |
| 3,519,491 | 7/1970 | Grohall et al. | 431/80 |
| 3,521,982 | 7/1970 | Dunn | 431/80 |
| 3,522,107 | 7/1970 | Kenyon | 136/217 |
| 3,615,872 | 10/1971 | Braucksiek | 136/217 |
| 3,620,849 | 11/1971 | Thompson | 136/217 |
| 3,650,843 | 3/1972 | Kenyon | 136/217 |
| 3,709,740 | 1/1973 | Kenyon | 136/217 |
| 3,802,829 | 4/1974 | Morris | 431/80 |
| 3,816,060 | 6/1974 | Koskolos | 431/80 |
| 3,859,034 | 1/1975 | Heyde et al. | 431/80 |
| 3,930,892 | 1/1976 | Fox et al. | 136/217 |

FOREIGN PATENT DOCUMENTS

| | | | |
|---|---|---|---|
| 539069 | 7/1955 | France | 248/300 |
| 242433 | 11/1925 | United Kingdom | 248/300 |

OTHER PUBLICATIONS

Penn Controls Brochure for Installation and Operation of Electrode Y80PM., 5/5/72.
Gas Industries, p. 5, Mar. 1977.
Penn Controls Brochure for "Slim Jim Clipper" Thermocouple, no date.

*Primary Examiner*—Carroll B. Dority, Jr.
*Assistant Examiner*—William R. Henderson
*Attorney, Agent, or Firm*—Fulwider, Patton, Rieber, Lee & Utecht

[57] ABSTRACT

There is disclosed a bracket and assembly for retrofit conversion of continuous pilot burners to intermittent, on-demand pilot burners. This conversion requires the mounting of a gas ignition electrode in the assembly. The mounting bracket for accomplishing this purpose is a flat metal stamping having a web with distal apertures bearing upstanding peripheral flanges about each aperture, and two pairs of bendable tabs. The bracket is installed with one aperture received about the conventional flame sensor assembly of the pilot burner, and the bendable tabs are bent about the supporting structure to secure the bracket and to support the additional electrode required by this conversion at a predetermined spacing relative to the pilot burner where the electrode tip can be readily bent to the proper air gap for spark ignition.

5 Claims, 9 Drawing Figures

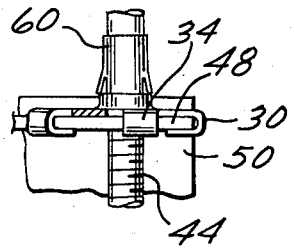
FIG. 6
FIG. 7
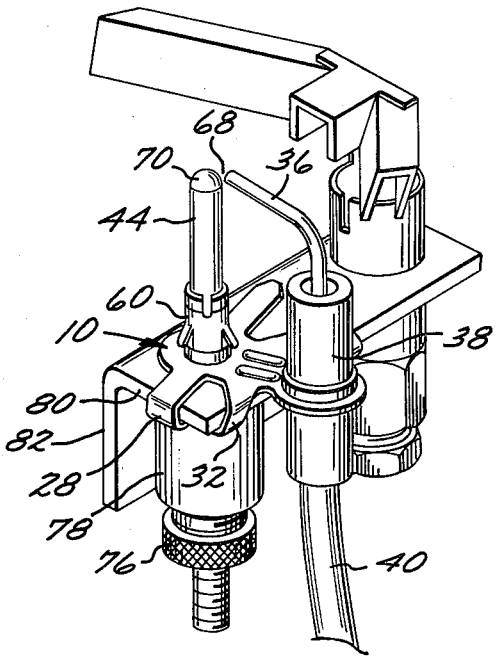
FIG. 8
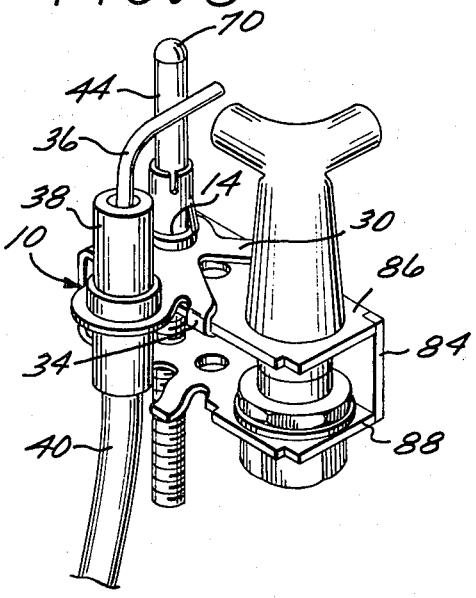
FIG. 9
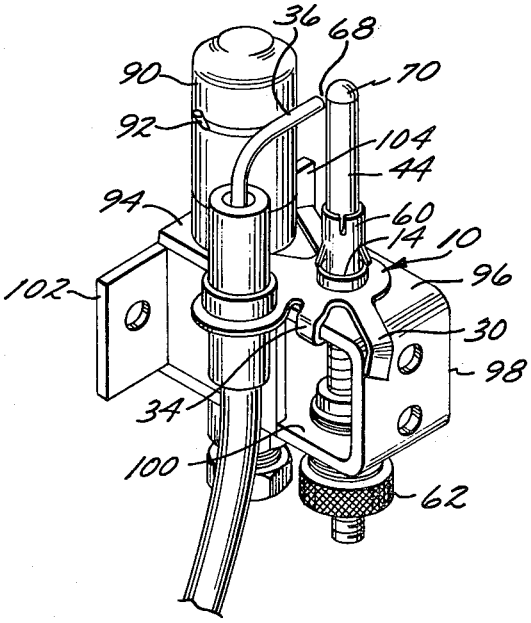

RETROFIT IGNITER

BRIEF STATEMENT OF THE PRIOR ART

The increasing cost of natural gas and concern for its conservation has developed the need for a facile retrofit conversion of continuous-operation pilot burners to intermittent, on demand-burners. This installation requires the mounting of a sparking electrode in the pilot burner assembly. Various proposals have been made for the design of a bracket which can be employed to attach to the existing pilot burner assemblies and provide support for the added sparking electrode. Most of these brackets are cumbersome and are costly to install, thereby inhibiting their widespread acceptance.

The typical, continuous-operation pilot burner assembly includes a pilot support such as an angle member, channel member, and the like. The pilot burner is supported on one end of this support member, and a flame sensor assembly is supported at the opposite end. This structure is quite compact and cannot be readily utilized for supporting another element such as a sparking electrode without incorporating supporting structure such as an auxiliary bracket. The assembly has quite limited dimensional tolerances. It is critical that the spark be discharged so that the gas stream from the burner is readily ignited. The spark gap must also be closely set to a spacing predetermined by the system voltage.

BRIEF STATEMENT OF THE INVENTION

This invention comprises a bracket which can be utilized for the retrofit conversion of continuous-operation pilot burners to intermittent, on-demand pilot burners. The bracket for this purpose can be readily secured to the existing structure of the continuous pilot burner assembly to provide the necessary auxiliary structure for supporting the sparking electrode at a correct orientation in the pilot burner assembly. For this purpose, the bracket is formed of a flat web having distal apertures interconnected by a central web portion. The web portion is preferably reinforced with webs that extend co-extensively between the apertures. The apertures are preferably reinforced by upstanding peripheral flanges.

At one end of the bracket a pair of bendable tabs projects radially outwardly from the respective aperture. A second pair of bendable tabs projects from the central web portion towards the opposite aperture to a predetermined lateral spacing relative to such aperture, thereby serving as spacer means to orient the sparking electrode which is received within the aperture, as hereinafter described.

The bracket is installed in a retrofit conversion by removing the fasteners securing the flame sensor assembly, placing of the bracket in the assembly with one of its apertures received about the flame sensor assembly, and locked thereto by replacing the fasteners of this assembly. The sparking electrode is received within the other of the apertures of the bracket, and the bendable tabs of the bracket are bent about the supporting structure to firmly secure the bracket in the assembly.

BRIEF DESCRIPTION OF THE DRAWINGS

The invention will be described by reference to the FIGURES of which:

FIG. 6 is a view along lines 6—6 of FIG. 5 and;

FIGS. 7–9 are views of other retrofitted burner and igniter assemblies.

DESCRIPTION OF PREFERRED EMBODIMENTS

Figure 1:
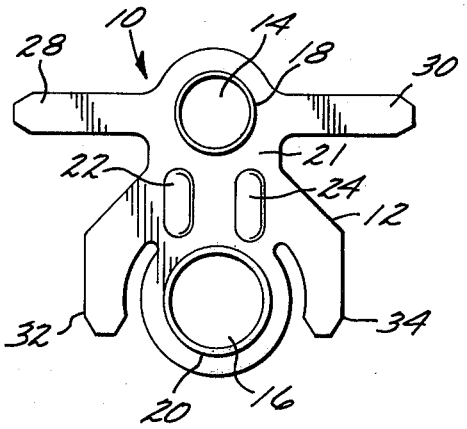
FIG. 1 is plan view of the retrofit bracket of the invention.

Referring now to FIG. 1, the retrofit bracket 10 comprises a flat web 12 bearing distal apertures 14 and 16. Each aperture is surrounded by an upstanding peripheral flange 18 and 20, and the central portion 21 of the web between the apertures bears one or more ribs 22 and 24 extending co-extensively between the apertures and serving as stiffeners for the central portion. Preferably, these ribs are simply upset beads stamped in the web sheet material.

The bracket bears a plurality of bendable tabs. A first pair of bendable tabs 28 and 30 project laterally from the region surrounding aperture 14. Preferably, these bendable tabs extend along radii of the aperture 14.

A second pair of bendable tabs 32 and 34 project from the central portion 21 of web 12 and project to laterally spacedapart positions about aperture 16. The lateral spacing of the second pair of bendable tabs 32 and 34 relative to aperture 16 is of significance not only for the use of the tabs 32 and 34, as means to secure the bracket to a supporting structure, but also as spacing means to obtain a predetermined alignment of the bracket in the assembly.

Figure 2:
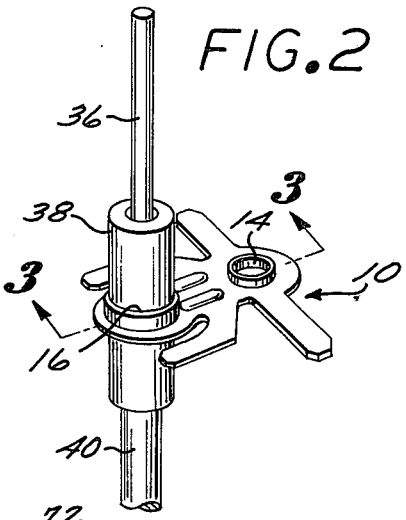
FIG. 2 is a view of the bracket and electrode assembly employed in the retrofit kit of the invention.
Figure 3:
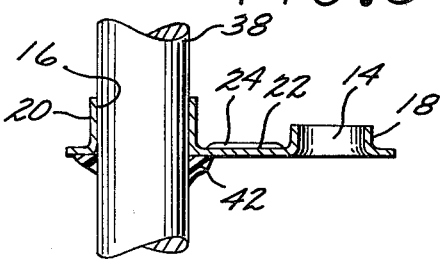
FIG. 3 is a view along lines 3—3 of FIG. 2.

Referring now to FIG. 2, the retrofit bracket 10 receives an igniter electrode assembly in aperture 16. The electrode assembly comprises a metal tip electrode 36 which projects from an insulator sleeve 38, typically formed of a ceramic, and an electrical conductor 40, which projects from the opposite end and which is in electrical continuity with the metal electrode tip 36. The ceramic sleeve 38 is positioned in aperture 16 and is secured thereto by ceramic cement 42 in the manner shown in FIG. 3.

Figure 4:
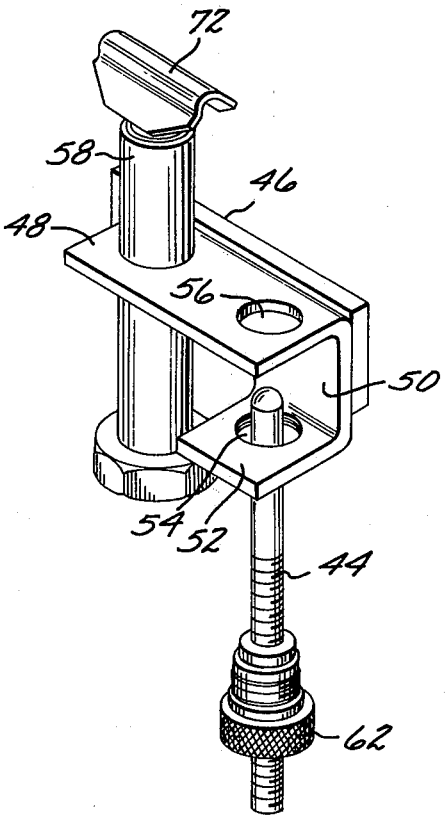
FIG. 4 illustrates the disassembly of a conventional, continuous pilot burner preliminarily to installing the retrofit kit of the invention.

Referring now to FIG. 4, the conventional, continuous-operation pilot burner assembly is disassembled by removing the fastening means from the tubular sheathing 44 which receives the flame sensor, typically a diastat bulb of the assembly. Tubular sheathing 44 bears a plurality of serrations along its length to provide gripping surfaces for fasteners such as spring clip nuts, and the like. The removal of the upper spring clip nut permits extraction of the sheathing in the illustrated of FIG. 4 from the burner assembly support 46. As there illustrated, the burner support 46 is generally defined by an angle bracket having a horizontal flange 48, a vertical flange 50, and second horizontal flange 52 having a bore 54 co-axial with a bore of the same diameter 56 in the horizontal flange 48. These coaxial bores receive the tubular sheathing 44. The pilot burner 58 is supported at the opposite end of flange 48.

Figure 5:
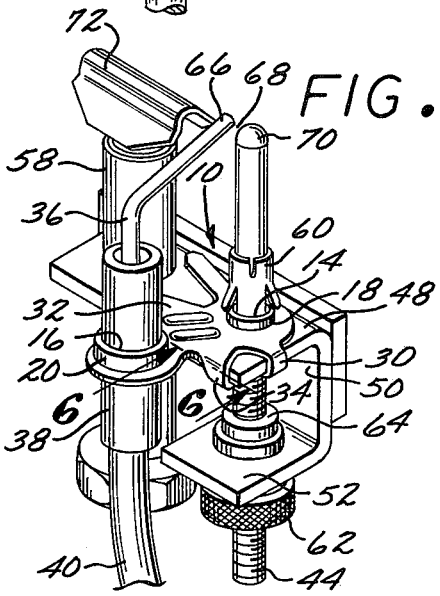
FIG. 5 illustrates the retrofitted burner and igniter assembly.

Referring now to FIG. 5, the completed retrofit installation is shown. As there illustrated, bracket 10 is installed over the horizontal bracket 48 of the mounting support for the pilot assembly. The aperture 14 is aligned with aperture 56 of the horizontal flange 48 of the burner support and the sheathing 44 for the flame sensor is inserted through the assembly. The spring clip 60 is placed over the sheathing this assembly. A nut 62 having a shank 64 with external threads is turned into the threaded bore 54 of the horizontal flange 52. This nut internally receives a second spring clip 60 which is secured about the serrated sheathing 44.

The additional, sparking electrode 36 is supported in the assembly with the tab 32 serving as a spacer aligned against the burner 58 thereby insuring the proper alignment of the electrode in the assembly. Thereafter, the upper end 66 of electrode 36 is bent into the deflected position as shown to provide an air gap 68 between the upper end of the diastat bulb 70 of the flame sensor or, alternatively between the electrode and the flame guard 72 of the pilot burner.

The bracket 10 is additionally secured in the assembly by bending the bendable tabs 30 and 34 about the upper horizontal flange 48 of the pilot burner support.

FIG. 6 illustrates the assembly, showing the bendable tabs 30 and 34 which are wrapped about the edges of the horizontal bracket 48 of the pilot burner support.

Referring now to FIG. 7, there is illustrated another, alternative embodiment in which the mounting bracket of the invention can be employed. As there shown, bracket 10 is placed similarly about the flame sensor sheathing 44 of a conventional flame sensor having a diastat bulb 70. The assembly is secured by a spring clip 60 and a subjacent nut 76 which engages against the bottom edge of a cylindrical boss 78 carried on the undersurface of the horizontal flange 80 of a mounting support 82 for this conventional pilot burner assembly. In this mounting, bendable tabs 28 and 32 are deflected about the horizontal flange 80 to secure the assembly. The sparking electrode assembly of the ceramic insulator sleeve 38, metal electrode tip 36 and conductor 40 are mounted to the mounting bracket in the same manner as previously described and the metal tip 36 is deflected to provide the proper air gap spacing 68 relative to an electrically grounded portion of the assembly such as the sheathing 44 of the flame sensor.

Referring now to FIG. 8, there is illustrated another typical installation. As there illustrated, the pilot burner support is formed by a channel member 84 having an upper horizontal flange 86 and lower horizontal flange 88. Bracket 10 is installed as previously described, with the sheathing 44 of the flame sensor extending through aperture 14 of bracket 10. The bendable tab 34 is wrapped about horizontal flange 86 and the other member 32 of this pair of bendable tabs, is similarly wrapped about this upper flange 86. Again, the sparking electrode assembly of the bent metal electrode tip 36, ceramic insulator 38 and conductor 40 are as previously described.

Referring now to FIG. 9, there is illustrated yet another pilot burner assembly. This assembly comprises a pilot burner 90 having a peripheral slot 92 for discharge of the combustible gas. The pilot burner 90 is mounted on a burner support 94 comprising an upper horizontal flange 96, an end vertical flange 98, a lower horizontal flange 100 with projecting side flanges 102 and 104 for securing the assembly to an appliance structure. In this assembly, bracket 10 is again mounted with the sheathing 44 of the flame sensor extended through aperture 14 of the bracket 10. A spring clip nut 60 is placed on the assembly which is secured with a thumbnut 62 such as previously described with reference to FIG. 5. The bendable tabs 30 and 34 are bent about the structure to secure the assembly of bracket 10 and the end of the metal electrode 36 is bent into proximity to a grounded point of the assembly such as sensor tip 44 to provide an air gap 68 as desired for proper ignition. The invention provides direct and precise location of the burner, spark electrode and flame sensor. The pre-set spacing of the electrode reduces the bending required for installation and this is of substantial advantage since the electrode has a limited range of bend radii and angle. The bracket also can be tightly secured to avoid dimensional changes during use.

The invention has been described with reference to the presently preferred embodiment with illustrations showing application of the invention to various pilot burner structures, illustrating the versatility and universal adaptability of the mounting bracket. It is not intended that the invention be unduly limited by this description of the presently preferred embodiment. Instead, it is intended that the invention be defined by the means, and their obvious equivalence, set forth in the following claims.

What is claimed is:

1. A bracket for retro-fit conversion of a continuous to an intermittent operating gas pilot burner having a pilot burner and a flame sensor mounted in side-by-side alignment on a support member which comprises:
   (a) a flat web with first and second spaced-apart distal apertures and upstanding peripheral flanges about said apertures;
   (b) stiffening rib means in the central portion of said web between, and parallel to the alignment of, said apertures;
   (c) a pair of bendable tabs laterally projecting from said web adjacent one of said apertures; and
   (d) a second pair of bendable tabs projecting from opposite side edges of the central portion of said web toward the other of said apertures.

2. The bracket of claim 1 wherein said one of said apertures is of a diameter to receive a mounting sheath surrounding said flame sensor.

3. The bracket of claim 1 wherein said second pair of bendable tabs project to a predetermined lateral spacing from said other of said apertures.

4. The bracket of claim 1 in combination with an electrode assembly comprising an insulator sleeve of a diameter to be received in the other of said apertures, an electrode received in one end thereof and an insulated conductor in the other end thereof in electrical continuity to said electrode.

5. A retrofitted pilot burner assembly comprising:
   (a) a pilot burner and a flame sensor carried in side-by-side alignment on a support bracket;
   (b) the bracket of claim 1 overlying the support bracket with said one aperture received about said flame sensor and secured thereto by fastener means engaging said sensor;
   (c) an electrode assembly comprising an electrode and an insulated conductor in electrical continuity received within an insulator sleeve mounted in the other of said apertures with said electrode bent toward, but separated by a predetermined air gap from, one of said pilot burner and flame sensor; and
   (d) bendable tabs of said first and second pairs of bendable tabs of said bracket projecting past and folded under the edges of said support member to restrain said member against movement.

* * * * *